US006221548B1

(12) United States Patent
Shiba et al.

(10) Patent No.: US 6,221,548 B1
(45) Date of Patent: Apr. 24, 2001

(54) TONER FOR MAKING AN INK PRINTED-LIKE IMAGE

(75) Inventors: Hiroaki Shiba, Yao; Tohru Takatsuna, Osaka; Takayuki Itakura, Mishima; Mamoru Kato, Yamatokoriyama; Masatomi Funato, Kazusa-machi; Akemi Kowari, Shijonawate, all of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/396,722

(22) Filed: Sep. 15, 1999

(30) Foreign Application Priority Data

Sep. 16, 1998 (JP) ..... 10-262046
Sep. 16, 1998 (JP) ..... 10-262047
Sep. 16, 1998 (JP) ..... 10-262048

(51) Int. Cl.[7] ..... G03G 9/09
(52) U.S. Cl. ..... 430/106
(58) Field of Search ..... 430/106, 45; 428/195

(56) References Cited

U.S. PATENT DOCUMENTS 5,273,853 * 12/1993 Urano et al. ..... 430/106
5,306,589 * 4/1994 Yamamoto et al. ..... 430/106
5,314,773 * 5/1994 Kubo et al. ..... 430/106
5,759,728 * 6/1998 Hagi et al. ..... 430/106
5,804,347 * 9/1998 Inoue et al. ..... 430/110

FOREIGN PATENT DOCUMENTS 60-7435 * 1/1985 (JP) ..... 430/106

OTHER PUBLICATIONS

"Charging Effects of Organic Pigments in Electrophotographic Toners", Dyes and Pigments 9, pp. 119–127, Macholdt et al., 1988.*

* cited by examiner

*Primary Examiner*—Christopher Rodee
(74) *Attorney, Agent, or Firm*—Smith Patent Office

(57) ABSTRACT

A toner for making an ink printed-like image, which causes less eyestrain resulting from continuously reading the toner image for a long time, is provided. The toner has main particles and each main particle includes 100 parts by weight of binder resin and 1 to 3 parts by weight of black coloring agent dispersed in the binder resin. A developer using the toner and printed matter obtained by using the toner are also provided.

5 Claims, 6 Drawing Sheets

TONER FOR MAKING AN INK PRINTED-LIKE IMAGE

This application is based on patent applications No. 10-262046, No. 10-262047, No. 10-262048 filed in Japan, the contents of which are hereby incorporated by references.

BACKGROUND OF THE INVENTION

1. Field of the Invention

The present invention relates to a toner used for electrophotographic printing, a developer including the toner, and printed matter made by using the developer. More particularly, it relates to a toner and a developer that can produce printed matter having ink printed-like images causing less eyestrain, and such printed matter.

2. Description of the Related Art

Conventionally, publications have been mainly prepared by offset printing, one of planographic printings. In the printing process, a plate having hydrophilic and lipophilic sections is prepared, an ink is applied to the surface of the plate, the ink is transferred to a rubber blanket, then the ink is printed on a paper sheet.

The printing method is advantageous for preparing more than thousands of publications, but not for preparing a small number of publications such as hundreds of publications. This is because preparation of the plate usually costs too much. This is one of the main reasons that make it difficult to republish out-of-print publications even if there is a demand for republishing such publications, since republication needs another set of plates.

One of the solutions of the problem may be preparing such a small number of publications by electrophotographic printing in which toner is used to form an image. However, although the printed matters are well adapted for being read continuously for a relatively short time, reading printed matters prepared by electrophotographic printing continuously for a long time is likely to make the reader's eyes tired.

SUMMARY OF THE INVENTION

It is an object of the present invention to provide a toner used in electrophotographic printing for making ink printed-like images or representations including characters and pictures, a developer using the toner, and printed matter prepared by the developer, which can be adapted for being read continuously for a long time period while reducing the fatigue for the readers' eyes.

According to an aspect of the present invention, a toner for making ink printed-like image has main particles. Each main particle comprises 100 parts by weight of binder resin and 1 to 3 parts by weight of black coloring agent dispersed in the binder resin.

According to another aspect of the present invention, a developer for making an ink printed-like image comprises carrier particles and the above-mentioned toner.

According to further aspect of the present invention, the printed matter comprises a printing material and an image formed on the material by the above-mentioned toner.

According to a further aspect of the present invention, the toner for making ink printed-like image has main particles. Each main particle comprises a binder resin and a coloring agent dispersed in the binder resin. An image formed by the toner has a lightness of 20 to 40, a hue (a) of −1.5 to 0.5, and a hue (b) of 1.5 to 6.5.

According to a further aspect of the present invention, the toner for making ink printed-like image has main particles. Each main particle comprises a binder resin and a coloring agent dispersed in the binder resin. The toner in the powder state has a lightness of 15 to 30, a hue (a) of −2.0 to 1.2, and a hue (b) of 0.5 to 5.5.

According to a further aspect of the present invention, the toner for making ink printed-like image has main particles. Each main particle comprises a binder resin and a coloring agent dispersed in the binder resin. The toner has 2.0 to 10.0% reflectance over the range of wavelengths from 400 to 700 nm and 3.0 to 10.0% of reflectance over the range of wavelengths from 580 to 640 nm.

DETAILED DESCRIPTION OF THE PREFERRED EMBODIMENTS

A variety of considerations have been made with regard to the differences between offset printing, one of the usual printing methods for preparing publications (referred to as "ink printing" hereinafter) and conventional electrophotographic printing (referred to as "toner printing" hereinafter), in order to solve the above stated eyestrain problems resulting from continuously reading printed matter made by toner printing for a long time. As a result, it was found that the eyestrain problems have some correlation to a tone of the printed image, which includes the parameters of hue, lightness, and image density.

Figure 1:
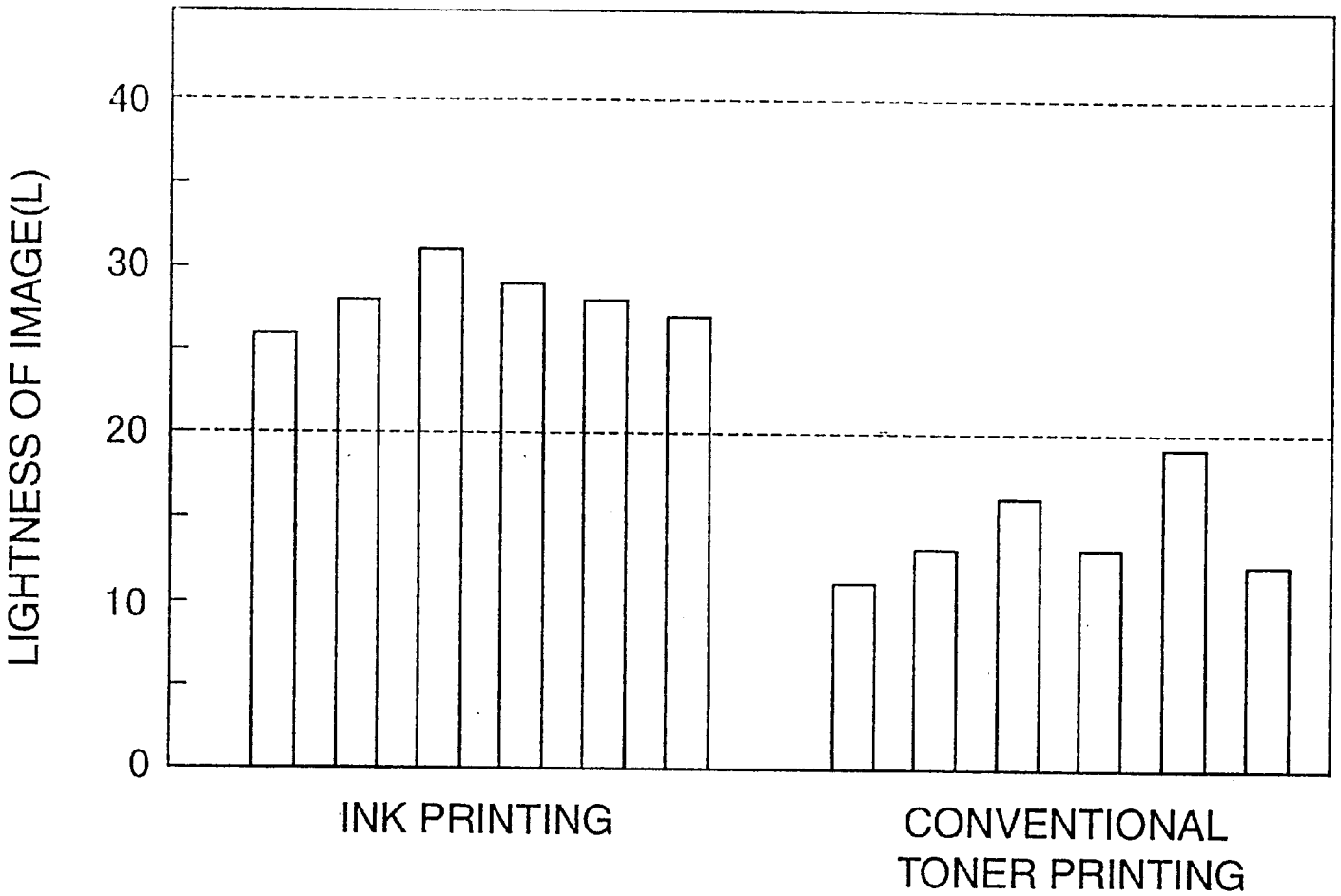
FIG. 1 is a graph comparing the lightness between images formed by conventional toner printing and by ink printing.
Figure 2:
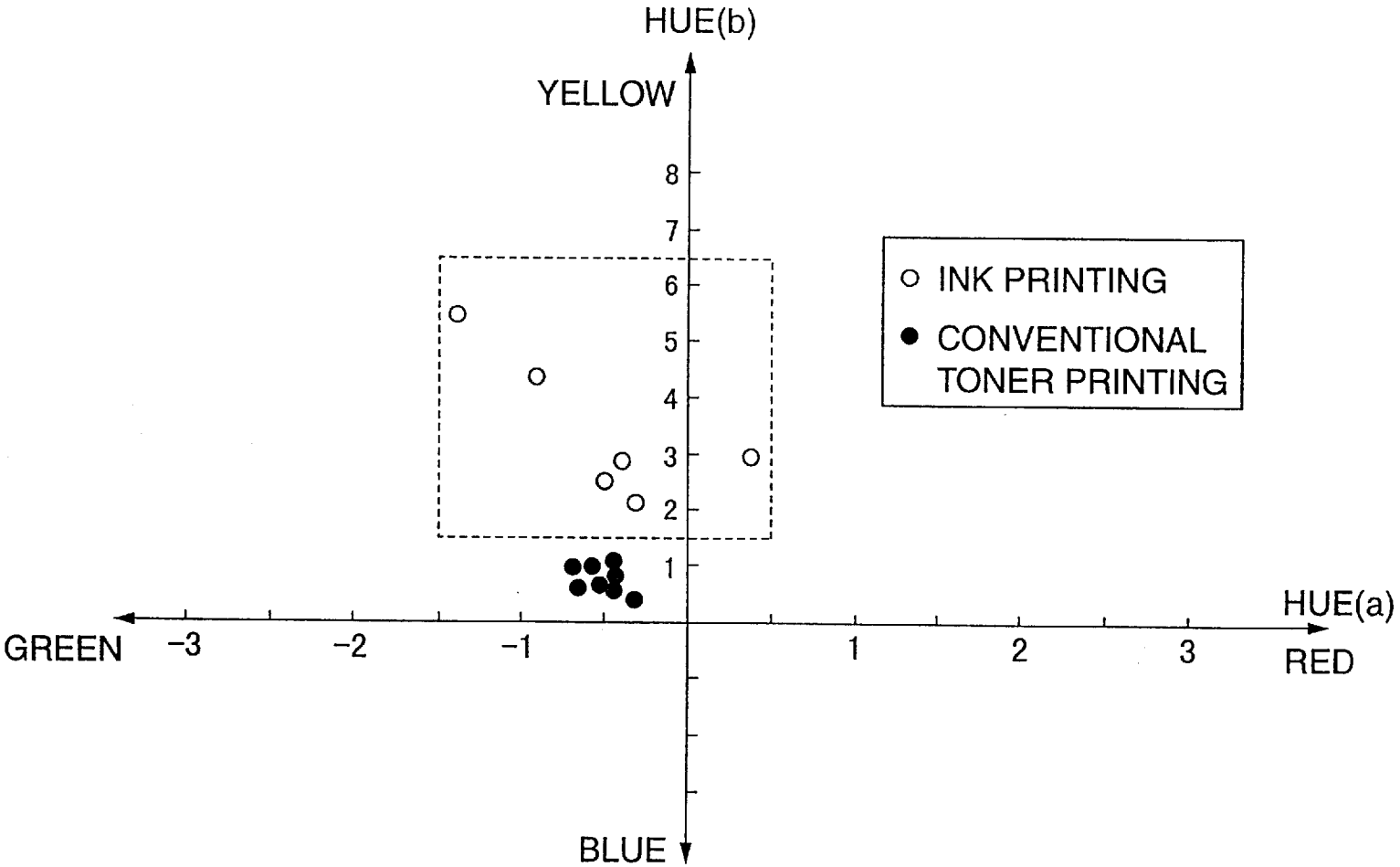
FIG. 2 is a graph comparing the hue between images formed by conventional toner printing and by ink printing.
Figure 3:
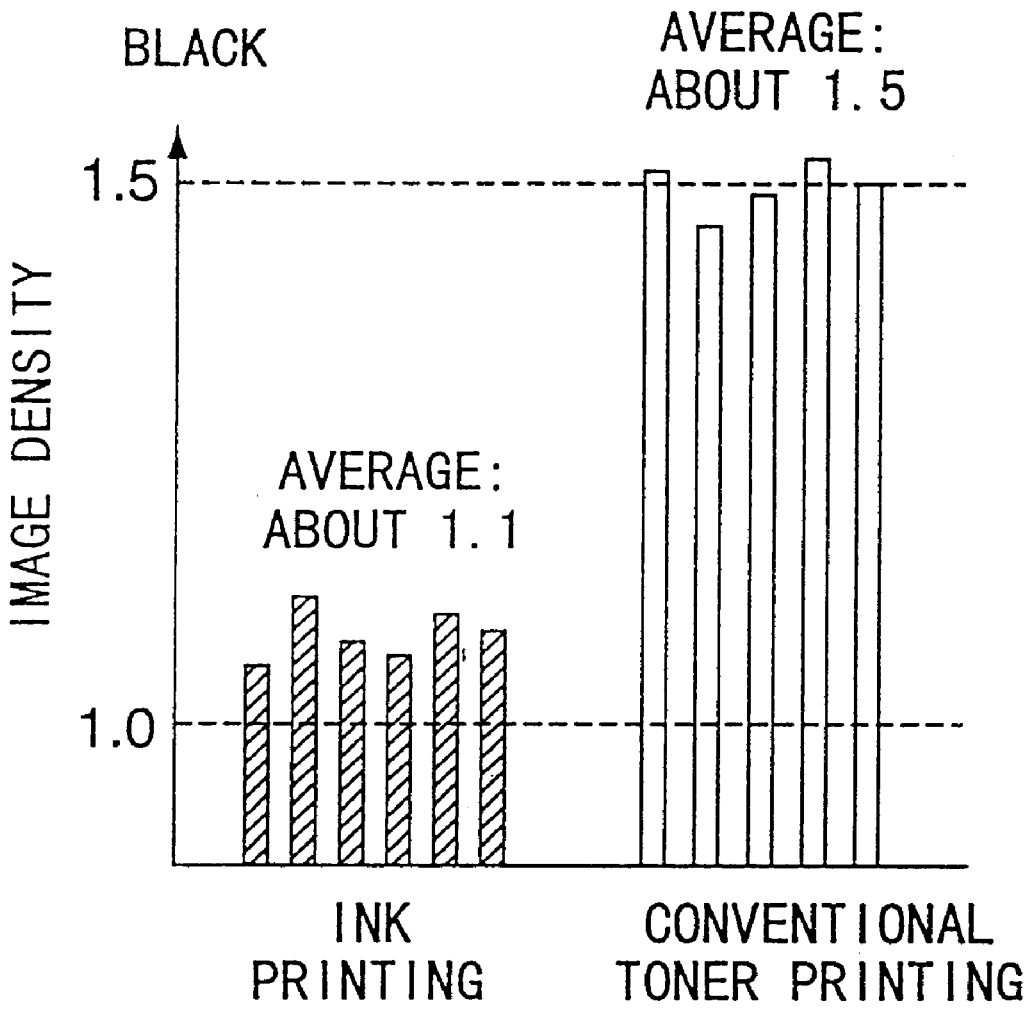
FIG. 3 is a graph comparing the image density between images formed by conventional toner printing and by ink printing.

The differences between lightness, hue and image density of the ink images made by ink printing and those of the toner images made by toner printing are shown in FIGS. 1, 2 and 3 respectively.

Referring to FIG. 1, the measured values of the lightness of conventional toner solid images, which are in a range of 10 to 20, are lower than those of ink images, which are in a range of 20 to 40. Generally, such images are formed on the white-base materials having a high lightness such as paper sheets. A colored image such as characters having lower lightness on such a white-base material irritates viewers' (or readers') eyes and causes eyestrains, due to an excessively strong contrast between the colored image and the white background.

Referring to FIG. 2, the hue of the printed solid image is shown as the combination of hue (a) (x-axis) and hue (b) (y-axis). As the value of hue (a) goes right-ward, a red color hue becomes stronger. On the contrary, as the value of hue (a) goes left-ward, a green hue becomes stronger. As the value of hue (b) goes up-ward, a yellow color hue becomes stronger. On the contrary, as the value of hue (b) goes down-ward, a blue hue becomes stronger. According to FIG. 2, although the hue (a) values of the conventional toner solid images are within the same range as those of the ink images, the hue (b) values of the conventional toner images are lower than those of the ink images. In other words, the ink image formed by offset printing has a stronger yellow hue than the toner image formed by conventional electrophotographic printing. This result matches a publishers' common knowledge based on experience, that is, printed matters subject to be read continuously for a long time are desired to have stronger yellow hue.

Referring FIG. 3, the average image density of the ink images is about 1.1, while that of the toner images is about 1.5. That is, the printed matter made by toner printing should have a stronger contrast between the density of the image and that of the white background, causing eyestrains.

From these results, toner for making an ink printed-like image preferably provides a solid image having an image density of about 1.1, a lightness of 20 to 40, hue (a) of −1.5 to 0.5 and hue (b) of 1.5 to 6.5, more preferably a lightness of 25 to 35, hue (a) of −1.0 to 0.0 and hue (b) of 2.0 to 6.0, in order to lessen eyestrain. Those values of solid images are referred to as "image lightness", "image hue (a)" and "image hue (b)" hereinafter.

To obtain the above described lightness and hue of the solid image, toner itself, i.e., toner in the powder state, preferably has a lightness of 15 to 30, hue (a) of −2.0 to 1.2 and hue (b) of 0.5 to 5.5, more preferably a lightness of 18 to 25, hue (a) of −1.0 to 0.5 and hue (b) of 1.0 to 3.0. Those values measured in the powder state of toner are referred to as "powder lightness", "powder hue (a)" and "powder hue (b)" hereinafter.

The preferable ranges of powder lightness and hue differ from image lightness and hue, because the measurements of powder lightness and hue are influenced by the presence of voids among particles contained in the toner, a glass container in which the toner is set for the measurements, or the like.

Figure 4:
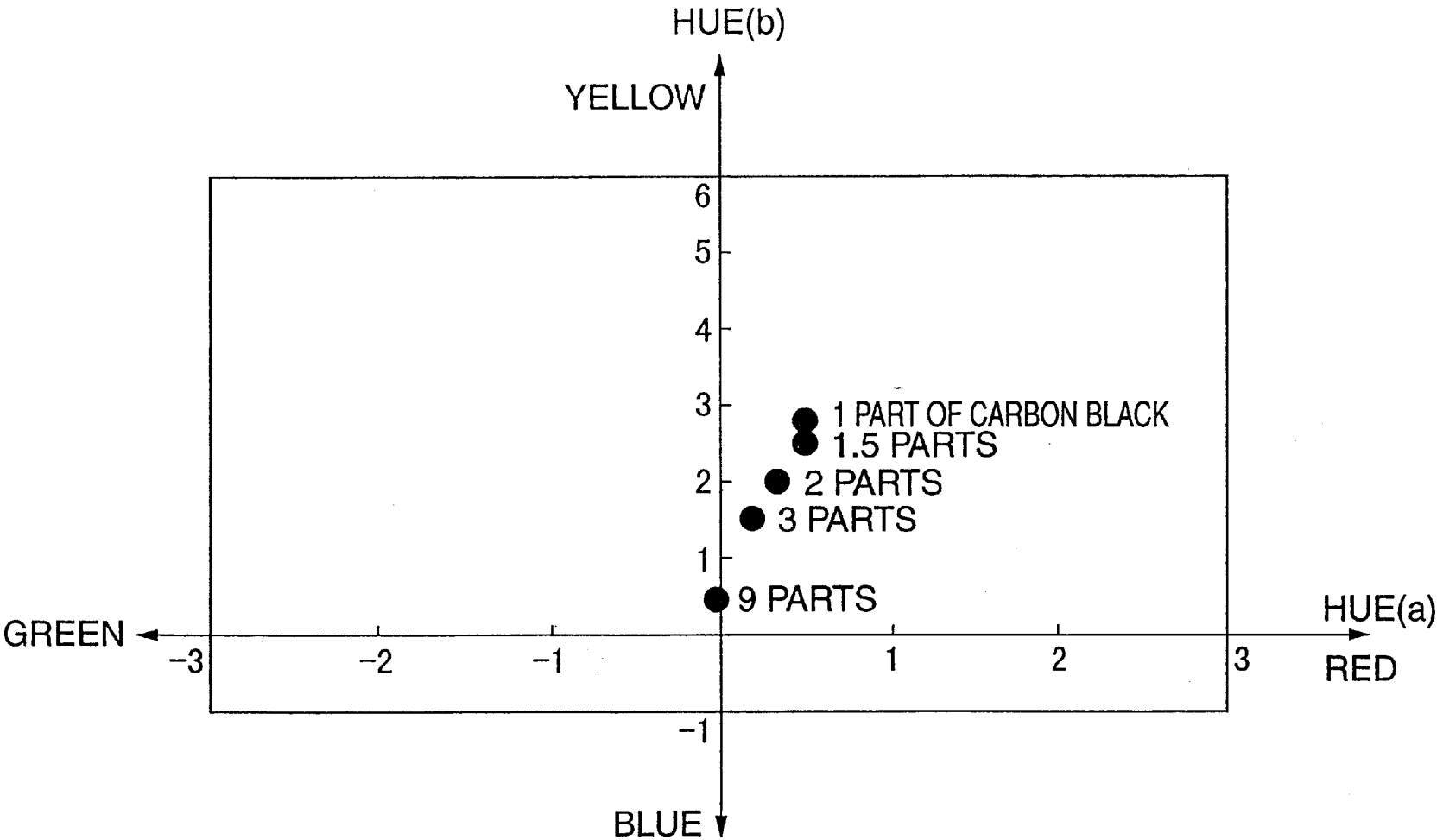
FIG. 4 is a graph showing the relationship between the hue of the toner in the powder state and the amount of carbon black contained in the toner.

In order to improve image density, lightness and hue of toner images to the approximately same levels as those of ink images, a variety of considerations have been made by inventors. The inventors finally found that one of the solutions relates to the amount of black coloring agent present in toner. The relationship between the amount of black coloring agent (carbon black) and powder hue is shown in FIG. 4. Also, the relationship between the amount of black coloring agent (carbon black) and powder lightness is shown in FIG. 5.

As shown in FIG. 4, as the amount of carbon black decreases, powder hue (a) goes right-ward, i.e., red hue becomes stronger, and powder hue (b) goes up-ward, i.e., yellow hue becomes stronger. In addition, as shown in FIG. 5, as the amount of carbon black decreases, powder lightness becomes higher along a hyperbola.

Figure 5:
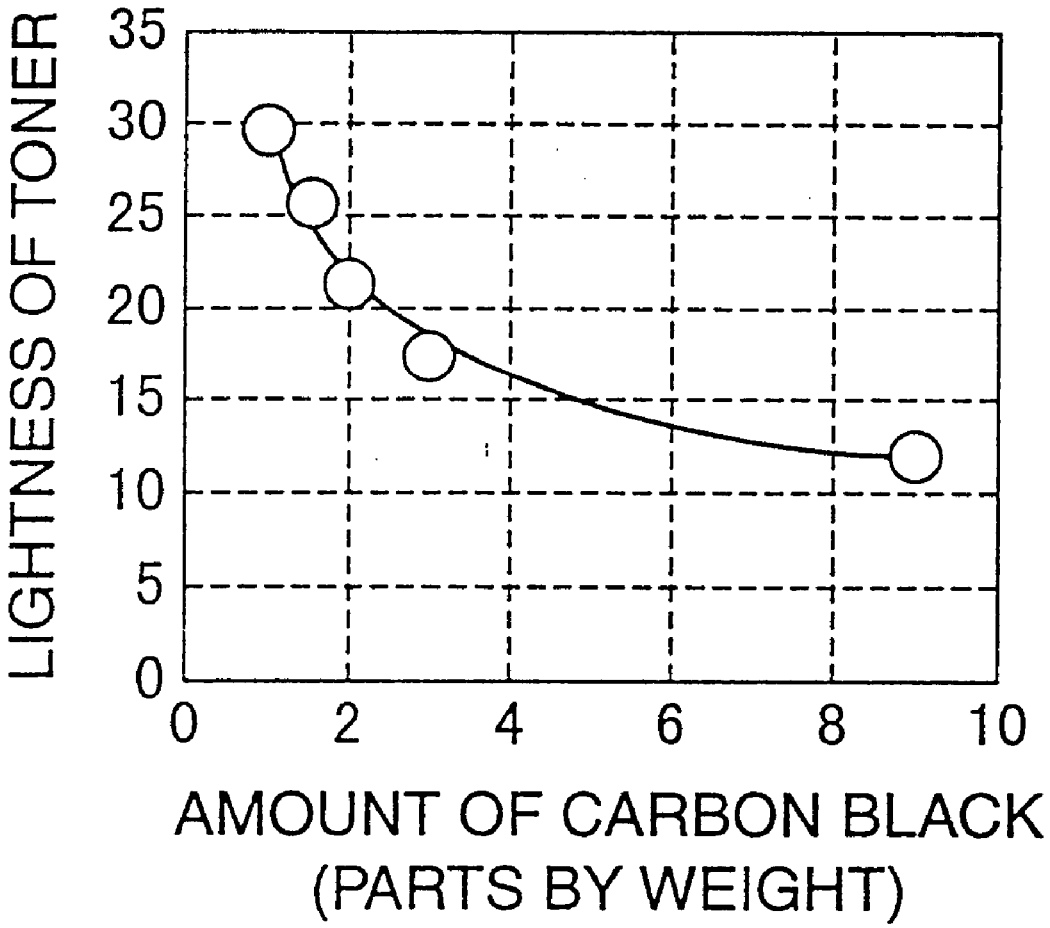
FIG. 5 is a graph of showing the relationship between the lightness of the toner in the powder state and the amount of carbon black contained in the toner.

From the results of FIGS. 4 and 5, the amount of black coloring agent is preferably 1 to 3 parts by weight to 100 parts by weight of the binder resin, in order to realize the above-mentioned desired lightness and hue.

This range of the carbon black amount differs from a conventional knowledge that more than 3 parts by weight of black coloring agent is desired to be contained in toner, since obtaining a clear image, e.g., an image having 1.3 or 1.4 or more of image density, has been given a priority. Thus, the toner of the present invention is totally different from known toners in the aspects of its purpose and technical concepts.

Also, the inventors found that using a predetermined amount of yellow and/or red coloring agent in combination with black coloring agent may improve the obtained toner image. Especially, 0.5 to 10 parts by weight, more preferably 1 to 5 parts by weight of yellow coloring agent and 0.5 to 10 parts by weight, more preferably 1 to 5 parts by weight of red coloring agent may be used individually or in combination. By adding those coloring agents, the hue and lightness of the image can be varied in accordance with the hue and lightness of the printing paper to be used in order to decrease the contrast of the image and the background.

In addition, the inventors found that by adjusting the reflectance of the powder state of toner they can solve the problem of a large contrast of lightness between the image and the white background.

In the present invention, the preferable spectral distribution curve of toner in the powder state has 2.0 to 10.0% reflectance over the range of wavelengths from 400 to 700 nm and 3.0 to 10.0% reflectance over the range of wavelength from 580 to 640 nm, more preferably 2.0 to 4.2% reflectance over the range of wavelengths from 400 to 700 nm and 3.0 to 4.0% reflectance over the range of wavelengths from 580 to 640 nm. The spectral distribution curve in the present invention is obtained by a color-difference spectrometer "SE-2000".

The above preferable range of reflectance over the range of wavelengths from 400 to 700 nm increases the lightness of the toner image, and thereby decreases the difference of the lightness between the image and the white background. This reflectance is effective to keep viewers or readers from eyestrain. In the case that the reflectance over this wavelength range is less than 2.0%, the lightness of toner image is likely to be too low, resulting in a large contrast of lightness between the image and the white background. On the other hand, in the case that the reflectance is more than 10.0%, the image is likely to have a very low density. The image may be difficult to read, especially in the case that the image is a character.

The above preferable range of reflectance over the range of wavelengths from 580 to 640 nm, i.e., yellow wavelength range, increase a yellow hue of the image. As described above, the image having a stronger yellow hue causes less eyestrain. Toner having are reflectance lower than the preferable range over the yellow wavelength range provides less yellow hue to the image. On the other hand, in the case that the reflectance is more than 10.0%, the image is likely to be too high in lightness. The image may be difficult to read, especially in the case that the image is a character.

Polyester resin used in the present invention is usually obtained by condensation polymerization of polyhydric carboxylic acids and polyhydric alcohols.

Examples of the polybasic carboxylic acids used in the polyester resin are aromatic polyhydric carboxylic acids such as phthalic acid, isophthalic acid, terephthalic acid, 1,2,4-benzene tricarboxylic acid, 2,5,7-naphthalene tricarboxylic acid, 1,2,4-naphthalene tricarboxylic acid and pyromellitic acid; fatty dicarboxylic acids such as maleic acid, fumaric acid, succinic acid, adipic acid, sebacic acid, malonic acid, azelaic acid, mesaconic acid, citraconic acid and glutaconic acid; alicyclic dicarboxylic acids such as cyclohexane dicarboxylic acid and methyl nadic acid; anhidrides and lower alkyl esters of these carboxylic acids. These materials can be used individually or in a combination of two or more kinds.

Since the degree of crosslinking depends upon the total amount of components of the alcohol having more than three hydroxyl groups and the carboxylic acid having more than three carboxyl groups, a desired degree of crosslinking is obtainable by adjusting the amounts of such components. It is usually preferable that the components are present in the amount of not more than 15 mol percent.

Examples of the polyhydric alcohols used in the polyester resin are alkylene glycols such as ethylene glycol, 1,2-propylene glycol, 1,3-propylene glycol, 1,4-butanediol, 1,4-butenediol, neopentyl glycol, 1,5-pentane glycol and 1,6-hexane glycol; alkylene ether glycols such as diethylene glycol, triethylene glycol, dipropylene glycol, polyethylene glycol, polypropylene glycol and polytetramethylene glycol; fatty polyhydric alcohols such as 1,4-cyclohexane dimethanol and hydrogenerated bisphenol A; bisphenols such as bisphenol A, bisphenol F and bisphenol S; and alkylene oxides of bisphenols. These materials may be used individually or in a combination of two or more kinds.

In order to obtain a polyester resin having a desired molecular weight and a desired acid value, monobasic carboxylic acid and monohydric alcohol may be used as required in the present invention. Examples of the monobasic carboxylic acid are benzoic acid, paraoxy benzoic acid, toluene carboxylic acid, salicylic acid. acetic acid, propionic acid and stearin acid. Examples of the monohydric alcohol are benzil alcohol, toluene-4-methanol and cyclohexane methanol.

The polyester resin used in the present invention is prepared by using the above materials in the usual way. For instance, alcohol compositions and acid compositions are placed in a reactor in predetermined amounts and, while an inert gas, e.g., nitrogen, is blown into the reactor, they are allowed to react at temperatures between 150 and 190° C. in the presence of a catalyst. Low molecular compounds by-produced in the course of the reaction is successively removed outside of the system. Thereafter, the reaction is accelerated by raising the reaction temperature to between 210 and 250° C., to obtain the desired polyester resin. The reaction can be conducted at atmospheric pressure, under reduced pressure, or at high pressure. After a conversion of 50 to 90% is reached, however, the reaction is preferably conducted under reduced pressure of not more than 200 mmHg.

Examples of the catalyst are metals such as tin, titanium, antimony, manganese, nickel, zinc, lead, iron, magnesium, calcium and germanium; metals thereof; and compounds containing these metals.

The glass transition temperature of the binder resin used in the invention is preferably from 45 to 90° C. If a toner contains the resin whose glass transition temperature is below 45° C., the toner is likely to solidify in a toner cartridge or developing machines. On the other hand, if a toner contains the resin whose glass transition temperature is above 90° C., the fixability of the toner to a transfer material is likely to be insufficient.

In the present invention, polyester resin is preferable as a binder resin contained in the toner to bind the coloring agent in order to prevent "unintended back-side transfers", especially in the process of bookbinding such as cutting printed sheets. The printed sheets are usually applied a high pressure, for example 1 ton/cm$^2$, to hold the sheets in place. This process is likely to cause "unintended back-side transfer", in which the toner image on a sheet partially transfers onto the back side of adjacent sheet placed directly over the sheet with the toner image. The mechanism of preventing unintended back-side transfer has not been made fully clear yet. However, it was found that the back-side transfer has some correlation to functional groups in the polyester resin having an affinity with the fiber of the printing paper and the smooth surface of the fixed image.

In addition to the polyester resin used in the present invention, if necessary, other resins may be jointly used as a binder resin, to such an extent that the effect of the present invention is not inhibited.

As the coloring agent incorporated in the polyester resin, there are black pigments such as acetylene black, lamp black and aniline black; yellow pigments such as chrome yellow, zinc chromate, cadmium yellow, yellow iron oxide, mineral fast yellow, nickel titanium yellow, naples yellow, naphthol yellow S, Hansa yellow G, Hansa yellow 10G, benzidine yellow G, benzidine yellow GR, quinoline yellow lake, permanent yellow NCG and tartrazine lake, orange color pigments such as chrome orange, molybdenum orange, permanent orange GTR, pyrazolone orange, Balkan orange, indanthrene brilliant orange RK, benzidine orange G, indanthrene brilliant orange GK; red pigments such as iron oxide red, cadmium red, red lead, mercury sulfide cadmium, permanent red 4R, lithol red, pyrazolone red, watching red calcium salt, lake red D, brilliant carmin 6B, eosin lake, rhodamine lake B, alizarin lake and brilliant carmin 3B; purple pigments such as manganese purple, fast violet B and methyl violet lake; blue pigments such as iron blue, cobalt blue, alkali blue lake, Victoria blue lake, phthalocyanine blue, metal-free phthalocyanine blue, partial chloride of phthalocyanine blue, fast sky blue and indanthrene blue BC; green pigments such as chrome green, chromium oxide, pigment green B, malachite green lake and Final Yellow Green G; and white pigments such as zinc white, titanium oxide, antimony white, zinc sulfide, baryta powder, barium carbonate, clay, silica, white carbon, talc and alumina white. In order to obtain a toner image having lightness and hue within the desired range, those coloring agents may be used individually or in a combination of two or more kinds. The above pigment is preferably present in an amount of from 0.1 to 20 parts by weight, more preferably from 1 to 10 parts by weight, to 100 parts by weight of a binder resin.

Of the above examples of a coloring agent, carbon black is the most preferable for the purpose of making an ink printed-like image. Specifically, carbon black having specific surface of 120 to 460 m$^2$/g and DBP oil absorption of 50 to 150 ml/100 g is preferred in terms of preventing an increase of the charge amount resulting from a decrease of conductive property. In this case, the preferable amount of carbon black is 1 to 3 parts in order to obtain preferable color of toner image.

In the present invention, specific surface of carbon black is measured by low temperature nitrogen gas absorption (BET method). DBP oil absorption means an amount of dibutylphthalate necessary for filling voids which are present among a predetermined amount of carbon black particles.

Electrophotography in the present invention means an image forming method in which a latent image is produced on a photoreceptor by using photoconductive phenomena, and a toner image is produced by adhering toner to the latent image with an electrostatic force.

The term "printed matter" in the present invention includes periodicals such as newspapers and magazines, and books such as monographs, complete works, art books (e.g., a book of paintings and photogravures) and dictionaries.

Preparation of the Toner

The toner according to the present invention can be prepared by a number of methods which are well known in the art, such as pulverization classification method, melt granulating method, spray granulating method, and polymerization method. In the pulverization classification method, for example, the above binder resin is premixed together with toner compositions which comprises, if necessary, a coloring agent, a charge control agent and a mold releasing agent, in a mixer such as Henschel's mixer, and the mixture is kneaded with a kneading machine, e.g., a biaxial extruder. The obtained kneaded composition is then cooled, pulverized and, if necessary, classified, to prepare main particles. The surface of the main particles may be coated with a surface treatment agent.

It may be preferable that the main particle has a median size from 5 to 15 $\mu$m, particularly from 7 to 12 $\mu$m, in terms of measurement of a Colter counter.

As a charge control agent, the invention can use any charge control agents that are normally usable. Examples of charge control agents of the positively charged type are nigrosine dye, fatty acid modified nigrosine dye, carboxyl group containing fatty acid modified nigrosine dye, quaternary ammonium salt, amine compounds and organic metallic compounds. Examples of charge control agents of the negatively charged type are metallic complex of hydroxy carboxylic acid, metallic complex of azo compound, metal complex dye and salicylic acid derivatives.

As a mold releasing agent incorporated in the binder resin, a variety of waxes and low molecular weight olefin resins can be employed. Examples of waxes are esters made from polyhydric alcohol and fatty acid, esters made from higher alcohol and fatty acid, alkylene bisfatty acid amid compounds, natural waxes or the like. Examples of the olefin resin are polypropylene, polyethylene and propylene-ethylene copolymer or the like, which have a number average molecular weight (Mn) of from 1000 to 10000, particularly from 2000 to 6000. Especially preferred as the olefin resin is polypropylene.

As a surface treatment agent, inorganic powder such as silica, alumina, titanium oxide, zinc oxide, magnesium oxide, calcium carbonate and magnetic powder; organic powder such as polymethyl methacrylate; and fatty acid metallic salt such as zinc stearate may be used solely or in a combination of two or more kinds, in order to improve controllability of the charge amount and flowability of the main particles. To mix the surface treatment agent with the main particles, any well-known mixing apparatuses can be employed, such as Henschel's mixer, V-shape mixture, Turbler's mixer, and Hybritizer.

The inventive toner may be mixed with a carrier as a two-component developer. Examples of a carrier are magnetic particles obtained by a predetermined method such as sintering and atomization from the following magnetic materials: magnetic metals including iron, nickel, cobalt or the like, and alloys thereof; alloys including rare earth element; soft ferrite such as hematite, magnetite, manganese-zinc ferrite, manganese- magnesium ferrite and lithium ferrite; iron oxides such as copper-zinc ferrite; and mixtures thereof. It is also possible to use these magnetic particles coated with a suitable resin as a carrier. In addition, resin particles in which magnetic particles dispersed can be used. In such case, the above described magnetic particles may be dispersed in the resin particles, and resins such as vinyl resin, polyester resin, epoxy resin, phenol resin, urea resin, polyurethane resin, polyimide resin, cellulose resin, polyether resin and mixtures thereof may be used as a binder resin for binding the magnetic particles to form the resin particles.

As the resin for coating the magnetic particles used in this invention, any thermoplastic and thermosetting resin is useable and no special limitations are imposed thereon. There are, for example, thermoplastic elastomers such as polyethylene, polypropylene, polyvinyl chloride, poly-4-methylpentene-1, polyvinylidene chloride, ABS (acrylonitrilebutadiene-styrene) resin, polystyrene, (meth) acrylic resin, polyvinyl alcohol resin, and thermoplastic elastomers such as polyvinyl chloride, polyurethane, polyester, polyamide and polybutadiene series; and thermosetting resins such as silicon resin, fluororesin, epoxy resin, xylene resin, guanamine resin, dialliylphthalate resin, phenol resin, vinyl ester resin, unsaturated polyester resin, polyurethane resin and melamine resin. Of these, silicon resin is more preferred to stabilize chargability of the toner. Specifically, a preferable silicon resin may be one that contains 30 to 80% by weight, and more preferably 40 to 60% by weight of phenyl radical.

To coat magnetite particles with resin, solution or dispersion liquid in which a coating resin is dissolved or dispersed may be applied to the surface of the particles. As a solvent of the solution or dispersion liquid, an aromatic hydrocarbons solvent such as toluene and xylene, a ketone solvent such as acetone, methylethylketone, methylisobutylketone and cyclohexanone, a cyclic ether solvent such as tetrahydrofuran and dioxane, an alcohol solvent such as ethanol, propanole and buthanol, a Cellosolve solvent such as ethylCellosolve and buthylCellosolve, an ester solvent such as ethyl acetate and butyl acetate, an amide solvent such as dimethyl formamide and dimethylacetamide may be used individually or in a combination of two or more kinds. The amount of the resin component to the total weight of the solution or dispersion liquid is preferably 0.001 to 30% by weight, more preferably 0.01 to 2% by weight.

As a method of applying the coating resin to magnetic particles, there are, for example, a spray drying method, a fluid bed method, a spray drying method using fluid bed, and a dipping method. Of these, the spray drying method may be particularly preferable because an effective application is attained with less coating resin.

The quantity of coating resin is adjustable. For the spray drying method, its adjustment may be effected by the amount of spraying resin liquid and spraying time. The preferable quantity of coating resin is 0.01 to 5% by weight, and more preferably 0.05 to 1.5% by weight to the total weight of coated carrier.

The absolute value of the saturated charge quantity of toner particles owing to friction with magnetic particles is usually from 5 to 35 $\mu$C/g, and preferably from 10 to 30 $\mu$C/g. The carrier may be of high or low electric resistance, and its electric resistance is usually from $10^5$ to $10^{10}$ $\Omega$·cm, preferably from $10^7$ to $10^9$ $\Omega$·cm.

Preferable particle size of the carrier used in the present invention may be from 30 to 200 $\mu$m, an especially from 50 to 150 $\mu$m, on the basis of electron microscopy. The apparent density of carrier may be usually from 2.0 to 3.0 g/cm$^3$. The density depends on the composition and the surface structure of the magnetite material contained in the carrier, if the carrier has magnetite material as a main component.

The saturation magnetization of magnetic particles contained in carrier may be preferably from 40 to 70 Am$^2$/kg.

A toner is preferably present in an amount of 1 to 10 wt %, and more preferably 1 to 7 wt %, to the total weight of the two-component developer. In the case that the amount of the toner is below 1 wt %, the obtained image made by using such a developer has too low an image density. On the contrary, in the case that the amount of a toner is above 20 wt %, the excessive amount of the toner is liable to cause "toner scattering" in the developing machines, resulting in the problem of adhering the excessive toner onto the background of the printed sheets. The term "toner scattering" means coloring particles scattered within an image forming apparatus by the centrifugal force exerted on a rotating magnetic brush. The presence of the scattered coloring particles on a path through which a transfer paper sheet is conveyed is likely to cause contamination of the rear face of the transfer paper.

A toner and developer according to the present invention is applicable to any known developing method such as one-component contact transfer developing method, one-component non-contact transfer method, two-component contact transfer developing method and two-component non-contact transfer method. Also, a toner and developer according to the present invention are applicable to any known fixing methods such as heat roller fixing with/without oil, flash fixing and oven fixing, and any known cleaning methods such as the fur brush method and the blade method.

A toner and developer according to the present invention can provide a satisfactory image when they are used in combination with any of an organic and inorganic photoreceptors. However, a photoreceptor suitable for the toner of the present invention is an organic photoreceptor including a layered photoreceptor, which has different functional layers, a generating charge layer and a carrying charge layer, and a single-layer photoreceptor, in which charge is generated and carried in the single layer.

Toner printing according to the present invention uses the above-described toner to form an image on a printing material, e.g., a printing paper. In the present invention, the printed matter made by the toner printing as above described is suitable for reading for a long period of time.

A printing material used in the present invention may be any known materials including a coated paper such as art paper, coat paper and light weight coat paper; and a non-coated paper such as printing paper A (chemical pulp: 100%) used for general commercial printed matters, for example, books, posters and textbooks, printing paper B (chemical pulp: 70%) used for books, magazines, textbooks or the like, printing paper C (chemical pulp: 40–70%) used for the telephone directory, magazines or the like, printing paper D, a paper used for photogravure of, e.g., magazines and printing reclaimed paper used for comic books.

In the case when paper is used as a printed material, a preferable air permeability of the paper, which represents a crude density of the paper, is 5 to 50 second. If the paper has very dense fiber, unintended back-side transfer is likely to occur. If the paper has very coarse fiber, it is difficult to print a clear image on such a paper.

In addition, a surface smoothness of a printed material is preferably 10 to 55 seconds. If the printed material has a very smooth surface, an unintended back-side transfer is likely to occur. If the printed material has a very rough surface, it is difficult to print a clear image on such a paper.

In the present invention, an air permeability and smoothness are both measured by an Oken type air permeability and smoothness testing machine ("KY-55" manufactured by Asahi-Seiki Mfg.).

A thickness of the printing material is preferably 50 to 13 $\mu$m for economic and practical reasons.

EXAMPLES

The following examples and comparative examples are being supplied to further define the present invention, it should be noted that these examples are intended to illustrate and not to limit the scope of the present invention. Parts and percentage (%) are by weight unless otherwise indicated.

A. Experiment 1

In this experiment, Toners A to E and a to d were prepared as follows by varying the amount and properties of the black coloring agent, the component of the binder resin and the amount of the mold releasing agent. The properties of images formed by those Toners such as image lightness, hue (a), hue (b), unintended back-side transfer level and durability against repeated printing were examined. The results are summarized in Table 1.

Example 1

(1) Preparation of the Toner 100 parts of Polyester resin made from bisphenol A as an alcohol component and succinic acid as a carboxylic acid component, 1.5 parts of carbon black "Printex70" (manufactured by Degusa, specific surface: 300 $m^2/g$, DBP oil absorption: 92 ml/100 g) as a coloring agent, 2.5 parts of styrene-acrylic resin having a functional group of quaternary ammonium salt ("FCA-196" manufactured by Hujikura Kasei Co., Ltd) as a charge control agent, 2.5 parts of low molecular weight polypropylene ("U-mex 100TS" manufactured by Sanyo Kasei Industries Ltd.) as a mold releasing agent were all placed in a Henschel's mixer and then mixed. This mixture was subjected to melt kneading by a biaxial extruder and then cooled by a drum flaker. Subsequently, this was roughly pulverized by a hammer mill, finely pulverized by a jet mill, and classified by a pneumatic classifier, to obtain main particles having a mean particle size of 8.5 micron.

As a surface treatment agent, 0.4 wt % of hydrophobic silica "TG850" having on its surface polydimethyl siloxane (manufactured by Cabot Corp.) and 0.1 wt % of titanium oxide "TAF-510P" (manufactured by Fuji Titanium Kogyo) were added to main particles and mixed with high speed stirring to prepare Toner A.

(2) Preparation of the Carrier

The mixture of iron oxide as a main component, copper oxide, Zinc oxide, magnesium oxide and carbon black was sintered to prepare copper-zinc ferrite magnetic particles. A resin solution for coating the surface of the magnetite particles was prepared by dissolving silicon resin having 80 wt % of phenyl radical into toluene. 3 kg of the magnetic particles were placed and flowed in a coating apparatus ("SPIR-A-FLOW MINI" manufactured by Froint Sangyo). 1 part of the resin solution to the 100 parts of the particles was put into the apparatus and sprayed to the flowing particles to coat the surface of the particles with the silicon resin. The particles were flowed for one hour, then they were dried to prepare the carrier.

(3) Developing method 3.5 parts of the toner and 96.5 parts of the carrier were mixed by a ball mill, to prepare a developer. This developer was put into a copying machine "Creage7325" (manufactured by Mita Industrial Co., Ltd.), then a toner image was formed on a printing paper (lightness (L): 92, hue(a): −1, hue(b): 10) by using the developer.

(4) Evaluation of unintended back-side transfer

The occurrence of unintended back-side transfer from the toner image was examined by: 1)putting another printing paper on the printing paper having the toner image; 2)applying a pressure of 1.1 ton/$cm^2$ on the papers; and 3)visually checking a level of unintended back-side transfer based on the following criteria.

"Level 1": The whole toner image is transferred.

"Level 2": The unintended back-side transfer is the middle level between "Level 1" and "Level 3".

"Level 3": The toner image is partially transferred.

"Level 4": The unintended back-side transfer is the middle level between "Level 3" and "Level 5"

"Level 5": The toner image is not transferred.

(5) Evaluations of Durability against repeated printing

Durability against repeated printing was examined by measuring the charge amount of the toner and image density before and after 1500 paper test printings. When the difference between values of the charge amount before and after the test printing was small enough (e.g., less than 10 $\mu$c/g), charge stability was, regarded to be high. Similarly, when the difference between values of the image density before and after the test printing was small enough (e.g., less than 0.3), stability of image density was regarded to be high. If the toner satisfied both, it was evaluated to have a satisfactory durability against repeated printing.

Example 2

Toner B was prepared in the same manner as in Example 1, except for the use of terephthalic acid in place of succinic acid as a carboxylic acid component and 5 parts of additives as a releasing agent. The same evaluations were made as those in Example 1.

Example 3

Toner C was prepared in the same manner as in Example 1, except for the use of 2 parts of coloring agent. The same evaluations were made as those in Example 1.

Example 4

Toner D was prepared in the same manner as in Example 1, except for the use of 2.5 parts of coloring agent. The same evaluations were made as those in Example 1.

Example 5

Toner E was prepared in the same manner as in Example 1, except for the use of carbon black having a specific surface of 260 $m^2$/g, DBP oil absorption: 123 ml/100 g as a coloring agent. The same evaluations were made as those in Example 1.

Comparative Example 1

Toner a was prepared in the same manner as in Example 1, except for the use of 0.8 parts of carbon black having a specific surface of 300 $m^2$/g, DBP oil absorption: 92 ml/100 g as a coloring agent coloring agent. The same evaluations were made as those in Example 1.

Comparative Example 2

Toner b was prepared in the same manner as in Comparative Example 1, except for the use of 3.5 parts of carbon black as a coloring agent. The same evaluations were made as those in Example 1.

Comparative Example 3

Toner c was prepared in the same manner as in Comparative Example 1, except for the use of styrene-acrylic resin and the use of 1.5 parts of carbon black as a coloring agent. The same evaluations were made as those in Example 1.

Comparative Example 4

Toner d was prepared in the same manner as in Comparative Example 1, except for the use of styrene-butadiene resin and the use of 1.5 parts of carbon black as a coloring agent. The same evaluations were made as those in Example 1.

TABLE 1

| | | Toner A | Toner B | Toner C | Toner D | Toner E | Toner a | Toner b | Toner c | Toner d |
|---|---|---|---|---|---|---|---|---|---|---|
| Toner | Binder Resin | Polyester resin made from BisphenolA And Succinic acid | ← terephthalic acid | ← Succinic acid | ← | ← | ← | ← | Styrene — acrylic resin | Styrene — acrylic resin |
| | Coloring Agent | | | | | | | | | |
| | Amount | 1.5 | 1.5 | 2 | 2.5 | 1.5 | 0.8 | 3.5 | 1.5 | 1.5 |
| | Surface | 300 | ← | ← | ← | 260 | 300 | ← | ← | ← |
| | DBP | 92 | ← | ← | ← | 123 | 92 | ← | ← | ← |
| | Releasing agent | Polypropylene | ← | ← | ← | ← | ← | ← | ← | ← |
| | Amount | 2.5 | 5 | 2.5 | ← | ← | ← | ← | ← | ← |
| Printings | Initial image | Good | Good | Good | Good | Good | Low ID | * | ** | Good |
| | Lightness | 25.5 | 25.1 | 23.5 | 22.2 | 25.3 | 29.2 | 19 | 28.3 | 24.9 |
| | Hue (a) | −0.58 | −0.17 | −0.22 | −0.25 | −0.16 | −0.11 | −0.09 | −0.3 | −0.15 |
| | Hue (b) | 5.39 | 4.8 | 5.1 | 4.6 | 4.9 | 7.1 | 2.9 | 4.1 | 4.9 |
| | Backside transfer | 5 | 5 | 5 | 5 | 5 | 2 | 3 | 1 | 1 |
| | Charge stab. | 8 $\mu$c/g ↑ | 8 $\mu$c/g ↑ | 4 $\mu$c/g ↑ | 2 $\mu$c/g ↑ | 8 $\mu$c/g ↑ | 13 $\mu$c/g ↑ | 4 $\mu$c/g ↑ | 2 $\mu$c/g ↑ | 3 $\mu$c/g ↑ |
| | Stab. Of image density | 0.15 ↓ | 0.25 ↓ | 0.1 ↓ | 0.05 ↓ | 0.2 ↓ | 0.4 ↓ | 0.1 ↓ | 0.04 ↓ | 0.03 ↓ |

*crashed character,

**solid image ununiform density

As shown in Table 1, Toner A to E formed the images having stronger yellow hue (Examples 1 to 5). Also those Toners gave good results in initial image and unintended back-side transfer. Furthermore, those Toners had high durability of repeated printing, since the differences of charge amount and of image density between before and after 1500 paper test printings were small enough.

On the contrary, Toner a in Comparative Example 1 having less black pigment (0.8 parts) provided the initial image having low density. This density was further decreased by 0.4 after the test printing, due to the increased charge amount of the toner. On the other hand, toner b in Comparison Example 2 having more black pigment (3.5 parts) provided the initial image having unreadable crushed characters. The image also has very low lightness and hue (b), which is likely to cause heavy eyestrain.

Toners c and d having styrene-acrylic resin or styrene-butadiene resin in place of polyester resin as a binder resin prepared in Comparison Examples 3 and 4 gave a high level of unintended back-side transfer.

B. Experiment 2

In this experiment, Toner A and F to H and e to h were prepared as follows by varying the amount of coloring agent including black, yellow and red pigments, and the eyestrain caused by the images made by those toners was evaluated. The results were summarized in Tables 2 and 3.

Example 6

Toner A, carrier and a developer were prepared in the same manner as in Example 1 of Experiment 1. The developing method applied in this example was also the same as that in Example 1. The obtained toner images were characters copied from a book (examples in this experiment used individual books). The reflectance of the toner and eyestrain resulting from the toner images were evaluated as follows.

(6) reflectance of toner

Figure 6:
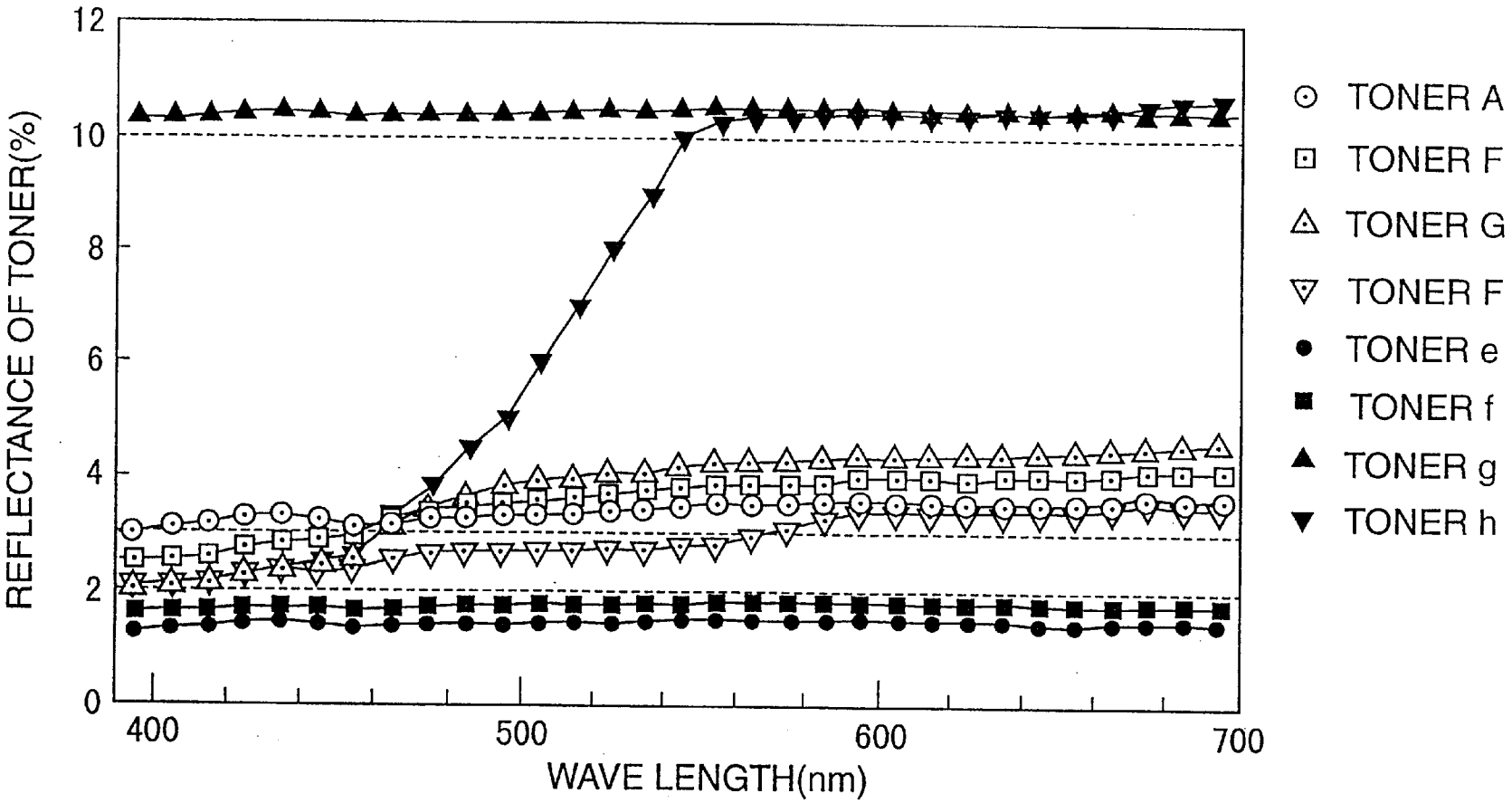
FIG. 6 is a graph showing the reflectance of the toner in the powder state as a function of wavelength.

The reflectance of the toner in the powder state was measured by a color-difference spectrometer "SE-2000" (manufactured by Nihon Denshoku Kogyo). The result was given is FIG. 6. (7) Evaluation of eyestrain Eyestrain resulting from reading the printed matter having characters formed by the toner was measured by the following test. Subjects of this test were 10 persons having a vision by the naked eye of 0.7–1.0. One of the reasons for excluding persons having a vision of more than 1.2 from the subjects of this experiment was because visions more than 1.2 cannot be measured at intervals of 0.1 byoptometer "Screenoscope SS-3" manufactured by TOPCON. The subjects read 10 thousand characters in printed matter for about one hour a day. Then, a vision reading measurement taken was within 5 minutes after they finished reading. A degree of eyestrain resulting from reading was obtained by calculating their difference between the vision before and after reading. The subjects read the printed matters made by each toner prepared in this experiment one by one for eight days running to examine the degree of eyestrain caused by each toner image.

In the present invention, the units of vision were based on the international standard that 1.0 of vision represents a vision capable of recognize a slit of a Landolt ring 5 meters away from the subject.

Example 7

Toner F was prepared in the same manner as in Example 1, except for the use of 2.5 parts of yellow pigment in addition to 1.5 parts of black pigment as a coloring agent. The same evaluations were made for Toner F.

Example 8

Toner G was prepared in the same manner as in Example 1, except for the use of 5.0 parts of yellow pigment in addition to 1.5 parts of black pigment as a coloring agent. The same evaluations were made for Toner G.

Example 9

Toner H was prepared in the same manner as in Example 1, except for the use of 2.5 parts of yellow pigment and 1.0 part of red pigment in addition to 1.5 parts of black pigment as a coloring agent. The same evaluations were made for Toner H.

Comparative Example 5

Toner e was prepared in the same manner as in Example 1, except for the use of 9.0 parts of black pigment as a coloring agent. The same evaluations were made for Toner e.

Comparative Example 6

Toner f was prepared in the same manner as in Example.1, except for the use of 5.0 parts of black pigment as a coloring agent. The same evaluations were made for Toner f.

Comparative Example 7

Toner g was prepared in the same manner as in Example 1, except for the use of 0.5 parts of black pigment as a coloring agent. The same evaluations were made for Toner g.

Comparative Example 8

Toner h was prepared in the same manner as in Example 1, except for the use of 8.0 parts of yellow pigment in addition to 1.5 parts of black pigment as a coloring agent. The same evaluations were made for Toner h.

TABLE 2

| | Toner A | Toner F | Toner G | Toner H | Toner e | Toner f | Toner g | Toner h |
|---|---|---|---|---|---|---|---|---|
| Image Lightness | 24.0 | 23.6 | 25.0 | 23.3 | 17.3 | 18.5 | 46.3 | 42.1 |
| Image Hue (a) | −0.7 | −1.2 | −1.4 | 0.3 | −0.9 | −0.5 | −1.0 | −2.8 |
| Image Hue (b) | 3.2 | 3.9 | 6.1 | 3.6 | 1.4 | 0.9 | 1.2 | 9.6 |
| Powder Lightness | 17.0 | 19.6 | 20.6 | 17.1 | 12.3 | 13.5 | 32.2 | 31.0 |
| Powder Hue (a) | 0.2 | −0.8 | −1.4 | 1.0 | −0.1 | −0.3 | 0.2 | −2.8 |
| Powder Hue (b) | 1.6 | 2.9 | 4.9 | 2.2 | 0.3 | 0.2 | 0.2 | 8.3 |
| Difference of visions | 0.02 | 0.03 | 0.07 | 0.03 | 0.23 | 0.21 | 0.18 | 0.18 |

TABLE 3

| | Toner A | Toner F | Toner G | Toner H | Toner e | Toner f | Toner g | Toner h |
|---|---|---|---|---|---|---|---|---|
| Subject No. 1 Before | 1.00 | 0.95 | 1.00 | 0.95 | 1.00 | 1.00 | 1.00 | 0.95 |
| After | 0.95 | 0.90 | 0.90 | 0.90 | 0.75 | 0.80 | 0.85 | 0.75 |
| Subject No. 2 Before | 0.90 | 0.90 | 0.95 | 0.90 | 0.85 | 0.90 | 0.90 | 0.85 |
| After | 0.90 | 0.90 | 0.90 | 0.85 | 0.65 | 0.70 | 0.75 | 0.70 |
| Subject No. 3 Before | 0.80 | 0.80 | 0.80 | 0.75 | 0.80 | 0.75 | 0.75 | 0.80 |
| After | 0.80 | 0.75 | 0.75 | 0.75 | 0.55 | 0.55 | 0.55 | 0.60 |
| Subject No. 4 Before | 0.70 | 0.70 | 0.65 | 0.70 | 0.70 | 0.70 | 0.65 | 0.70 |
| After | 0.65 | 0.65 | 0.55 | 0.65 | 0.50 | 0.55 | 0.50 | 0.55 |
| Subject No. 5 Before | 0.90 | 0.90 | 0.85 | 0.90 | 0.90 | 0.85 | 0.90 | 0.90 |
| After | 0.90 | 0.85 | 0.80 | 0.80 | 0.65 | 0.60 | 0.70 | 0.70 |
| Subject No. 6 Before | 0.80 | 0.75 | 0.80 | 0.80 | 0.75 | 0.80 | 0.80 | 0.80 |
| After | 0.75 | 0.75 | 0.75 | 0.80 | 0.55 | 0.55 | 0.60 | 0.60 |
| Subject No. 7 Before | 0.85 | 0.85 | 0.85 | 0.85 | 0.85 | 0.80 | 0.85 | 0.85 |
| After | 0.85 | 0.85 | 0.80 | 0.85 | 0.65 | 0.60 | 0.70 | 0.70 |
| Subject No. 8 Before | 1.00 | 1.00 | 0.95 | 1.00 | 1.00 | 1.00 | 0.95 | 1.00 |
| After | 0.95 | 0.95 | 0.85 | 0.95 | 0.70 | 0.75 | 0.70 | 0.80 |
| Subject No. 9 Before | 0.95 | 0.95 | 0.95 | 0.90 | 0.90 | 0.95 | 0.95 | 0.90 |
| After | 0.90 | 0.90 | 0.85 | 0.90 | 0.65 | 0.70 | 0.75 | 0.70 |
| Subject No. 10 Before | 0.75 | 0.75 | 0.75 | 0.75 | 0.75 | 0.70 | 0.75 | 0.70 |
| After | 0.75 | 0.75 | 0.70 | 0.70 | 0.55 | 0.55 | 0.60 | 0.55 |
| Average visions | 0.87 | 0.86 | 0.86 | 0.85 | 0.85 | 0.85 | 0.85 | 0.85 |
| | 0.84 | 0.83 | 0.79 | 0.82 | 0.62 | 0.64 | 0.67 | 0.67 |
| Difference | 0.02 | 0.03 | 0.07 | 0.03 | 0.23 | 0.21 | 0.18 | 0.18 |

In Examples 6 to 9 using Toner A and F to H, the differences between vision before and after reading were 0.07 or less, whereas ones in Comparison Examples were 0.18 or more. That is, Toners A and F to H containing 1 to 3 parts of carbon black resulted in less eyestrain to the subjects than Toner e to h. Thus, it was found that eyestrain due to the toner image can be improved by adjusting the amount of black coloring agent such as carbon black contained in toner.

By adding yellow and/or red pigments in addition to carbon black as a coloring agent, toner having an increased hue (b) was provided (Toners B and D). Toners B and D caused eyestrain to the approximately same extent as toner having only carbon black (Toner A) in this experiment, in which the continuous reading time was set to one hour. However, from the viewpoint of the image hue (b), when the continuous reading time is set longer, toner having yellow and/or red pigments as well as 1 to 3 parts of carbon black may be more effective for improving readers' eyestrain than a toner having only carbon black as a coloring agent.

What is claimed is:

1. A toner for making an ink printed-like image having main particles, each main particle comprising:

100 parts by weight of binder resin;

1 to 3 parts by weight of black coloring agent dispersed in the binder resin; and 2.5 to 5 parts by weight of red and/or yellow coloring agent;

wherein an image formed by the toner has a lightness of 20 to 40, a hue (a) of −1.5 to 0.5, and a hue (b) of 1.5 to 6.5.

2. A toner for making an ink printed-like image having main particles, each main particle comprising:

100 parts by weight of binder resin;

1 to 3 parts by weight of black coloring agent dispersed in the binder resin; and 2.5 to 5 parts by weight of red and/or yellow coloring agent;

wherein the toner in the powder state has a lightness of 15 to 30, a hue (a) of −2.0 to 1.2, and a hue (b) of 0.5 to 5.5.

3.A toner according to claim 2, wherein the lightness of the toner is 18 to 25, the hue (a) is −1.0 to 0.5, and the hue (b) is 1.0 to 3.0.

4. A toner for making an ink printed-like image having main particles, each main particle comprising:

100 parts by weight of binder resin;

1 to 3 parts by weight of black coloring agent dispersed in the binder resin; and 2.5 to 5 parts by weight of red and/or yellow coloring agent;

wherein the toner has 2.0 to 10.0% of reflectance over a range of wavelengths from 400 to 700 nm and 3.0 to 10.0% of reflectance over a range of wavelengths from 580 to 640 nm.

5. A toner according to claim 4, wherein the toner has 2.0 to 4.2% of reflectance over the range of wavelengths from 400 to 700 nm and 3.0 to 4.0% of reflectance over the range of wavelengths from 580 to 640 nm.

* * * * *